United States Patent [19]

Kato

[11] 4,186,087

[45] Jan. 29, 1980

[54] METHOD AND APPARATUS FOR SEPARATING SUBSTANCES FROM LIQUIDS BY FLOTATION USING BUBBLES

[75] Inventor: Yoshishige Kato, Tokyo, Japan

[73] Assignee: Director-General of Agency of Industrial Science and Technology, Tokyo, Japan

[21] Appl. No.: 897,790

[22] Filed: Apr. 19, 1978

[30] Foreign Application Priority Data

Apr. 22, 1977 [JP] Japan ..... 52-46571

[51] Int. Cl.[2] ..... B03D 1/24

[52] U.S. Cl. ..... 210/44; 210/221 P

[58] Field of Search ..... 210/13, 44, 221 P; 209/164, 168, 170

[56] References Cited

U.S. PATENT DOCUMENTS

| | | | |
|---|---|---|---|
| 1,374,499 | 4/1921 | Greenawalt | 209/168 |
| 1,434,232 | 10/1922 | Sherwood | 209/170 |
| 1,646,019 | 10/1927 | Forrester | 210/221 P |
| 1,847,659 | 3/1932 | MacLennan | 209/170 |
| 1,861,156 | 5/1932 | Fahr et al. | 209/168 |
| 2,669,440 | 2/1954 | Lindenbergh | 210/221 P |
| 3,371,779 | 3/1968 | Hollingsworth | 209/170 |
| 3,520,415 | 1/1970 | Cymbalisty | 210/221 P |
| 3,616,919 | 11/1971 | Feddern | 210/221 P |
| 3,932,282 | 1/1976 | Ettelt | 210/221 P |

FOREIGN PATENT DOCUMENTS

| | | | |
|---|---|---|---|
| 105330 | 9/1937 | Australia | 209/170 |
| 712026 | 1/1941 | Fed. Rep. of Germany | 210/221 P |
| 1005479 | 2/1964 | United Kingdom | 209/170 |
| 493440 | 11/1975 | U.S.S.R. | 210/221 P |

*Primary Examiner*—Charles N. Hart
*Assistant Examiner*—Ernest G. Therkorn

[57] ABSTRACT

A method for separating substances from liquid by flotation using bubbles which comprises adsorbing a substance present in a liquid on bubbles, floating the bubbles adsorbing the substance and separating the substance from the bubbles, characterized by allowing the bubbles adsorbing the substance to ascend through a fluid route in a tube independent of the ambient turbulently flowing liquid and then collecting and separating the substance from the liquid at the upper end of the tube. An apparatus for separating substances from liquids by flotation using bubbles which comprises a vertical column provided at the bottom thereof with a gas-diffusing means and a tube placed inside the vertical column, the tube being smaller in diameter and length than the vertical column and being provided with a means for collecting bubbles at the lower end thereof and a means for accommodating and concentrating the collected bubbles at the upper end thereof. These method and apparatus are useful for the treatment of waste water and industrial effluents or of mineral extracts, especially for the purpose of recovering useful substances from a solution or suspension thereof or removing heavy metals and the like harmful substances from effluents.

4 Claims, 3 Drawing Figures

METHOD AND APPARATUS FOR SEPARATING SUBSTANCES FROM LIQUIDS BY FLOTATION USING BUBBLES

BACKGROUND OF THE INVENTION

1. Field of the Invention

The present invention relates to a method for separating substances from liquids by flotation and also to an apparatus useful for the method. More particularly, the present invention relates to an improvement in a method for separating substances from liquids by flotation wherein substances present in liquids such as water are adsorbed on bubbles and separated by flotation and in an apparatus useful for such method.

2. Description of the Prior Art

In the prior art, a method wherein a gas is introduced into water to form bubbles and various kinds of substances existing in water are adsorbed on the ascending bubbles and separated from the water by flotation is known as a means for removing useful or undesirable substances present in water. Especially known hitherto in this art are, for example, a method wherein a gas is introduced in the presence of a proper capturing agent into a solution containing ionic substances such as heavy metal ions and all or a part of such ionic substances are reacted or associated with the capturing agent and adsorbed on the formed bubbles thereby separating the substance or substances from the solution (ion flotation method) and a method wherein a gas is introduced into a solution containing dissolved or suspended substances to be removed and a surfactant and then the substances are adsorbed on the formed bubbles and separated from the solution (foam separation method).

Such separation methods utilizing flotation are applied to the recovery of useful substances dissolved or suspended in liquids or to the treatment of waste water where harmful substances are removed from water. In these cases, the use of a large column is required for conducting the method on a large industrial scale. However, the use of such large column is attended with a troublesome problem in that turbulent flows including vortical and circulating flows of the liquid formed partially or integrally (from the upper part to the lower part of the column) in the column seriously reduce the separation efficiency by flotation (referred to hereinafter simply as "separation efficiency") of the substances adsorbed on the formed bubbles. When the diameter of the column is relatively small, e.g. not greater than 4–5 cm, the formation of such vortical and circulating flows can be prevented by the action of the inner wall of the column. If a larger column which is greater in the diameter is used for a large industrial scale operation, however, it is quite impossible to prevent the formation of such vortical and circulating flows of the bubbled liquid, thus reducing the separation efficiency seriously and making the operation economically unattractive. Accordingly, the use of a great number of columns having a relatively small diameter will be compelled in the treatment of a large volume of a liquid, if it is desired to maintain a practically high separation efficiency. However, the use of such a greater number of columns makes the operation extremely complicated and is not suitable for a large scale practical operation from both technical and economical viewpoints. Under these circumstances, there is a great demand for the treatment of large volumes of liquid for development of a new separation method utilizing flotation which entirely overcomes these drawbacks in the prior art.

BRIEF SUMMARY OF THE INVENTION

It is an object of the present invention to provide a new method for separating substances from liquids by flotation wherein a large column is used.

It is another object of the present invention to provide an improved method for separating substances from liquids by flotation wherein a large scale operation is conducted at a high separation efficiency without any difficulty.

It is still another object of the present invention to provide an apparartus for separating substances from liquids by flotation which comprises a large column and a tube being placed inside the column and provided with a means for collecting bubbles at the lower end thereof and a means for accommodating and concentrating the collected bubbles at the upper end thereof for enhancing the separation efficiency.

Other objects, features and advantages of the present invention will become more fully from the following description.

DETAILED DESCRIPTION OF THE INVENTION

As a result of extensive researches made with the purpose of overcoming the drawbacks in the prior art methods using a large column and developing an improved method for separating substances from liquids by flotation on a large scale, it has now been found that the above mentioned purpose can be attained by forming in the interior of the column an independent liquid route connecting the top and the intermediate part of the column, through which route bubbles adsorbing a substance to be separated are allowed to ascend without being disturbed by the ambient vortical and circulating flows of the liquid.

In accordance with one embodiment of the present invention, there is provided a method for separating substances from liquids by flotation using bubbles which comprises adsorbing a substance present in a liquid on bubbles, floating the bubbles adsorbing the substance and separating the substance from the bubbles, characterized by allowing the bubbles adsorbing the substance to ascend through a fluid route in a tube being placed inside the column so as to connect the top and the intermediate part of the column and being independent of the ambient turbulently flowing liquid, and thereafter collecting and separating the substance from the liquid at the upper end of the tube.

In accordance with another embodiment of the present invention, there is provided an apparatus for separating substance from liquids by flotation using bubbles which comprises a vertical column provided at the bottom thereof with a gas-diffusing means and a tube placed inside the vertical column so as to connect the top and the intermediate part of the column, the tube being provided with a means for collecting bubbles at the lower end thereof and a means for accommodating and concentrating the collected bubbles at the upper end thereof.

The method and apparatus of the present invention are featured by using a large vertical column capable of treating a large volume of a liquid at a time and a specific tube placed inside the column, which is capable of forming a fluid route independent of the ambient liquid flows, whereby the separation efficiency is enhanced remarkably as compared with the case of using a large vertical column alone as in the prior art methods.

The present invention can more fully be understood from the following description taken in conjunction with the accompanying drawings in which.

The column used in the present invention may be any of the conventional ones used in this art but its diameter is large enough (at least 4–5 cm) to be able to treat a large volume of liquid at a time. The material suitable for the apparatus is a metal such as steel, copper or an alloy of various metals; wood; glass or porcelain; a resinous material such as a hard polyvinyl resin or hard rubber; or a combination thereof. It will easily be understood that if a liquid to be treated is a corrosive solution or suspension, the apparatus should be made of an anticorrosive material such as an enameled metal or glass-lined metal, stainless steel, glass or a resinous material.

Figure 1:
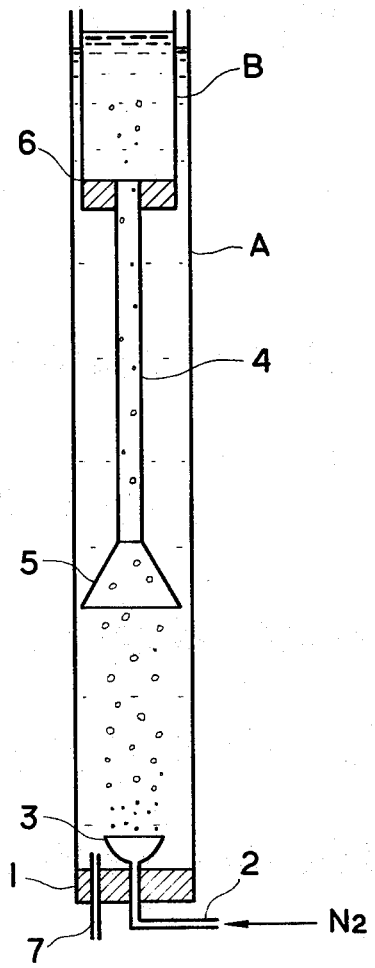
FIG. 1 is a longitudinal section view of a simplified example of the apparatus of this invention.

In FIG. 1, A is a cylindrical column vertically set and B is an assembly placed inside the column in accordance with this invention to enhance the separation efficiency of bubbles during flotation. In general, the column has a diameter of 5–30 cm, preferably 8–20 cm and a length of 0.8–5 m, preferably 1–3 m and is provided at the bottom plate 1 with a gas inlet 2 which penetrates through the bottom plate and has a gas-diffusing means 3 at the upper end thereof. The assembly B to be inserted in accordance with the present invention into the column A comprises at least one fluid tube 4 provided at the lower end thereof with a collecting means 5 for collecting bubbles and at the upper end with an accommodating means 6 for accommodating and concentrating the collected bubbles. The fluid tube 4 is a hollow tube made of a material as referred to in the case of the column and has a diameter not greater than 4–5 cm and a length corresponding to about 8–25 of the full length of the column, e.g. 15–125 cm, so as to ensure that the collected bubbles may ascend smoothly through the fluid route in the tube at a high efficiency without detaching the substance adsorbed on the bubbles. The tube 4 forming a fluid route is conveniently inserted cocentrically into the column, but may be placed more or less eccentrically so far as the desired separation efficiency is achieved. When the size of the column is sufficiently large, more than one fluid tube are inserted thereinto symmetrically or asymmetrically in traverse cross section. The number of the fluid tubes 4 will depend upon the size of the column. When plural fluid tubes are used, they may have different diameters not greater than 4–5 cm. The fluid tube is inserted into the column in such manner that the lower end of the tube may be located in a place within the range from 5% to 70% of the length of the column.

The gas-diffusing means 3 is, for example, a conical injection nozzle having a great number of small holes through which a gas pumped through the gas inlet 2 is bubbled. Any gases can be utilized in this apparatus unless they disturb the operation or are significantly absorbed in the liquid to be treated. Examples of useful gases include air, inert gases such as nitrogen and carbon dioxide and a mixture thereof. The use of air is preferable in the present invention. As seen in the conventional methods, various additives such as a pH adjusting agent, surfactant, precipitating agent and the like may be added to the liquid to be treated. The collecting means 5 is preferably in the form of a downwardly set funnel or a dome capable of efficiently collecting ascending bubbles. Especially preferble as the accommodating means 6 is a cyclindrical chamber where the bubbles are gathered and collapsed to retain the substance separated from the liquid. If desired, the accommodated bubbles may be transferred continuously or occasionally to a separate container. The size of the collecting means 5 and the accommodating means 6 are limited to have a diameter smaller than that of the column so that they may be placed in the column with a circumferential clearance sufficient enough to permit the free movement of the liquid in upward and downward directions.

The method of the present invention is carried out by introducing a liquid to be treated into the column from the upper open end thereof while injecting a gas such as an inert gas, for example, nitrogen through the gas inlet and the gas-diffusing means 3 to form a great number of bubbles in the liquid, whereby the substance to be recovered or removed is adsorbed on the bubbles. In case the operation is carried out batchwise, introduction of the liquid is interrupted when the level of the liquid approaches the upper end of the chamber of the accommodating means 6. In case the operation is carried out continuously, the liquid is introduced into the column from the upper open end thereof and discharged from a liquid outlet 7 fitted to the bottom plate 1 of the column. In this case, care should be taken lest the externally supplied liquid be entered in the chamber of the means 6. The treated liquid and the concentrated liquid are then taken out continuously from the liquid outlet 7 and the chamber of the means 6, respectively, and subjected to analysis. The continuous operation is carried out similarly to the batch method. In this case, the volume of the introduced liquid is at all times regulated constantly by using a level meter.

The bubbles formed by the gas-diffusing means 3 are allowed to ascend in the liquid whereby the substance to be separated is adsorbed on the surface of the bubbles. The bubbles are then collected by the collecting means 5 and ascend through the fluid route formed in the tube 4 to the upper end of the tube where the bubbles are entered in the accommodating means and concentrated there. Although the operation is conducted in a large column, the apparatus of the present invention where bubbles adsorbing the substance are allowed to ascend through a fluid tube or tubes having a small diameter does not permit any reduction in the separation efficiency as seen in the prior art method wherein a large column is used. It is observed that turbulent flows such as vortical and circulating flows of the liquid occur in the interior of the column A below the assembly B, but such turbulent flows of the liquid do not occur in the fluid tube 4. Thus, the whole assembly B including the accommodating means is substantially independent of the ambient flows of the liquid, and as a result, the separation efficiency is not influenced by the ambient flows of the liquid and the bubbles accommodated in the accommodating means are not redispersed nor redissolved. As a clearance is formed between the inner wall of the column A and the outer wall of the assembly B, the liquid in the upper, middle and lower parts of the column flows freely so that no difference in temperature is formed between the upper and lower parts of the liquid. As the operation is carried out by introducing a gas, the substance to be separated is gradually concentrated in the chamber of the means 6 while the concentration of the substance in the liquid is accordingly reduced.

It is a significant merit of this invention that bubbles adsorbing the substance to be separated are allowed to ascend through the fluid route formed in the tube having a small diameter independent of the ambient flows of the liquid without the substance being detached from the bubbles. Thus, the separation efficiency achieved by the present invention is extremely high as compared with the case of providing no independent fluid route for bubbles. In short, the present invention is to substitute a low efficient separation with a large column by a high efficient separation with a small column as independent fluid route.

The method and apparatus of this invention is particularly suitable for recovery of useful substances from liquids or for removal of harmful substances from liquids. Thus, the present invention is useful in the fields of sewage, extraction and mining.

The present invention will now be illustrated in greater detail by way of examples.

EXAMPLE 1

An apparatus having the structure as shown in FIG. 1 was used in this experiment. A column A was a vertically set cylindrical container of 244.46 cm in length and 8.57 cm in inner diameter while an assembly B was a glass tube the lower end of which was connected to a funnel of 8.4 cm in outer diameter and 80 cm in height and the upper end of which was penetrated through the bottom of a cylindrical glass container of 6.6 cm in outer diameter and 42.5 cm in height and opened in the interior of the container. In this apparatus, the distance between the bottom of the column A and the upper end of the glass tube 4 (the portion connected to the means 6) was fixed to 187.6 cm.

Using this apparatus, a flotation test was carried out in the following manner: An aqueous solution of Crystal Violet chloride having a concentration of $0.5\times10^{-6}$ g/ml was placed as test liquid in the column so that the level of the solution reached a height of 210 cm from the bottom. Nitrogen was introduced through a gas inlet 2 fitted to the bottom plate of the column and jetted as bubbles into the solution from a gas-diffusing means 3.

While continuously introducing nitrogen, Crystal Violet chloride in the solution was absorbed on the bubbles and collected in the chamber of the means 6 in the assembly B. In this test, the test time was 90 minutes and the flow rate of the nitrogen gas was 1–20.5 ml/sec.

The test result obtained was evaluated by sampling the liquid from the bottom of the column A and the liquid accommodated in the means 6 of the assembly B and subjecting the samples to quantitative analysis where the concentration of Crystal Violet chloride in both samples were compared by a spectrophotometer using the light of 5830 Å.

The glass tube 4 was selected from 24 kinds of glass tubes having a combination of six different lengths of 0, 20, 40, 60, 80, 100 and 120 (cm) and four different inner diameters of 1.25, 1.76, 2.20 and 2.50 (cm).

Figure 2:
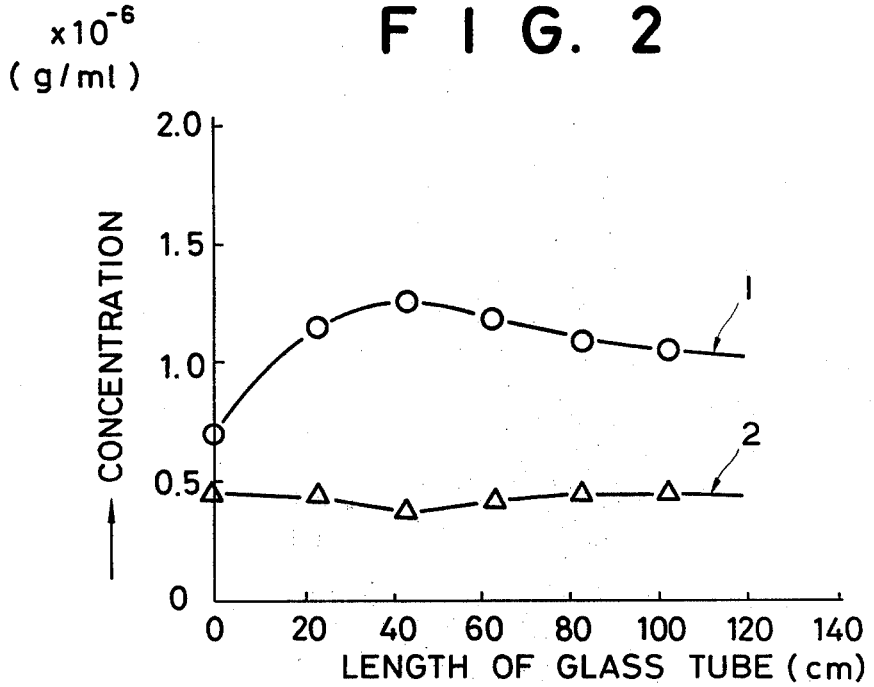
FIG. 2 is a graph showing the results of separation tests conducted according to the method of this invention wherein the column is used together with a tube forming an independent fluid route.

As a result of these tests respectively conducted for 90 minutes, it has been found that the separation efficiency becomes poor in either case of the length of the glass tube 4 is too long or too short and that among the glass tubes having various diameters, ones having a length of 40 cm exhibited the best result. Concerning the diameter, the glass tubes having an inner diameter of 2.20 cm exhibited the highest separation efficiency. FIG. 2 is a graph showing the result of flotation tests wherein the inner diameter of the glass tubes was fixed to 2.20 cm and the length thereof were varied. In this graph, the abscissa stands for the length of the glass tube in terms of centimeter, while the ordinate stands for the concentration ($\times10^{-6}$ g/ml) of the substance in the sample. Curve 1 shows the results obtained for the sample taken from the chamber of the means 6 while Curve 2 shows the results obtained for the sample taken from the bottom of the column A.

Figure 3:
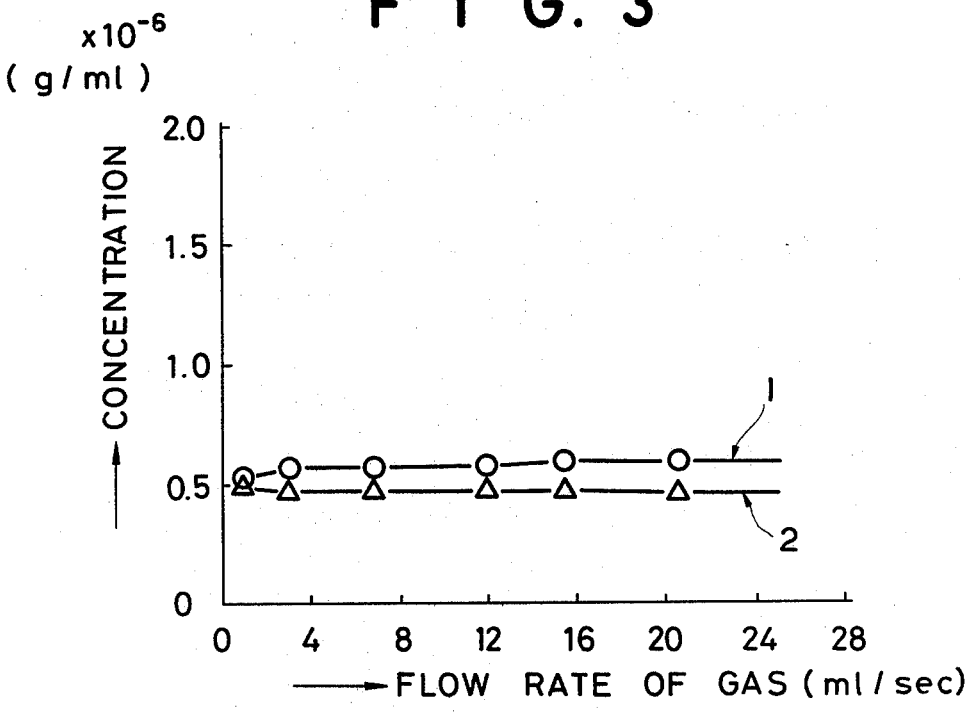
FIG. 3 is a graph showing the results of separation tests conducted according to the method for comparison wherein the column alone is used.

For the purpose of comparison, the test was repeated in the same manner as described above except that the assembly B was not employed. The test result in this case is shown in FIG. 3 wherein the relation between the flow rate of the gas in terms of ml/sec. the concentration of the substance in terms of ($\times10^{-6}$ g/ml) are graphically plotted. In FIG. 3, Curve 1 shows the results obtained for the sample taken from the upper part of the column A while Curve 2 the results obtained for the sample taken from the lower part of the column. These results obviously show that no substantial difference in concentration was found between both samples and the separation efficiency in the case of using a large column alone for flotation was extremely low.

EXAMPLE 2

Using an assembly B comprising a glass tube of 2.20 cm in diameter and 40 cm in length and the solution having various concentrations, a floatation test was carried out in the same manner as described in Example 1. A result of the test is shown in the following table.

TABLE

| Test No. | Initial concentration (Ci) ($\times10^{-6}$ g/ml) | Flow rate of gas (ml/sec.) | Ratio of concentrations $C_T/C_B$ | $C_T$/Ci | $C_B$/Ci |
|---|---|---|---|---|---|
| 1 | 0.4 | 1.0 | 1.92 | 1.78 | 0.93 |
| 2 | 0.4 | 2.5 | 1.87 | 1.87 | 0.98 |
| 3 | 0.4 | 7.0 | 2.60 | 2.28 | 0.88 |
| 4 | 0.4 | 11.0 | 3.23 | 2.50 | 0.78 |
| 5 | 0.4 | 15.7 | 3.43 | 2.58 | 0.75 |
| 6 | 0.5 | 1.0 | 1.65 | 1.62 | 0.98 |
| 7 | 0.5 | 2.5 | 1.88 | 1.84 | 0.98 |
| 8 | 0.5 | 7.0 | 2.47 | 2.22 | 0.90 |
| 9 | 0.5 | 12.0 | 2.65 | 2.28 | 0.86 |
| 10 | 0.5 | 15.7 | 2.90 | 2.44 | 0.84 |
| 11 | 1.0 | 1.0 | 1.62 | 1.44 | 0.89 |
| 12 | 1.0 | 2.5 | 1.93 | 1.62 | 0.84 |
| 13 | 1.0 | 7.0 | 2.10 | 1.85 | 0.88 |
| 14 | 1.0 | 12.0 | 2.62 | 2.33 | 0.89 |
| 15 | 1.0 | 15.7 | 2.91 | 2.50 | 0.86 |
| 16 | 1.0 | 20.5 | 3.02 | 2.48 | 0.82 |
| 17 | 3.0 | 1.0 | 1.56 | 1.43 | 0.92 |
| 18 | 3.0 | 2.5 | 1.83 | 1.59 | 0.87 |
| 19 | 3.0 | 7.0 | 2.38 | 1.99 | 0.83 |
| 20 | 3.0 | 11.0 | 2.77 | 2.21 | 0.80 |
| 21 | 3.0 | 15.7 | 3.38 | 2.53 | 0.75 |
| 22 | 3.0 | 2.05 | 3.67 | 2.56 | 0.70 |
| 23 | 5.0 | 1.0 | 1.42 | 1.37 | 0.96 |
| 24 | 5.0 | 2.5 | 2.10 | 1.85 | 0.88 |
| 25 | 5.0 | 7.0 | 2.79 | 2.15 | 0.77 |
| 26 | 5.0 | 11.0 | 3.69 | 2.40 | 0.65 |
| 27 | 5.0 | 15.7 | 3.70 | 2.44 | 0.66 |

In the above table, Ci stands for the initial concentration of substance in the liquid, CB for the concentration of the substance in the liquid at the bottom of the column A and CT for an average concentration of substance in the chamber of the accommodating means in the assembly B. In each test, the Ci value was as follows:

| | |
|---|---|
| $Ci = 0.4 \times 10^{-6}$ g/ml | for Test Nos. 1–5 |
| $Ci = 0.5 \times 10^{-6}$ g/ml | for Test Nos. 6–10 |
| $Ci = 1.0 \times 10^{-6}$ g/ml | for Test Nos. 11–16 |
| $Ci = 3.0 \times 10^{-6}$ g/ml | for Test Nos. 17–22 |
| $Ci = 5.0 \times 10^{-6}$ g/ml | for Test Nos. 22–27 |

These results show that the CT/CB ratio is as high as 2.9–3.7 and that at any initial concentration Ci the CB/Ci and CT/Ci ratios are almost constant to the respective flow rate of gas.

As many apparently widely different embodiments of this invention may be made without departing from the spirit and scope thereof, it is to be construed that this invention is not limited to the specific embodiments illustrated in examples except as defined in the appended claims.

What is claimed is:

1. In a method for removing substances from liquids in a column by flotation using bubbles which comprises passing downwardly through the column a liquid containing the substances to be removed, while bubbling a gas through the column countercurrently to the descending liquid, so as to bring the liquid into contact with the gas and thus adsorb the substance on the ascending bubbles, which are then collected and separated from the liquid in the upper part of the column, the improvement consisting in collecting and passing said ascending bubbles through at least one pre-established fluid path formed by a corresponding number of conduits having a diameter not greater than 4–5 cm and a length corresponding to about 8–24% of the total length of the column and placed within said column and extending from an intermediate portion of said column to the upper portion thereof, said conduits being independent of the ambient turbulently and downwardly flowing liquid, and gathering and collapsing the bubbles to retain the substance separated from the liquid.

2. The improvement according to claim 1 wherein said gas is selected from the group consisting of air and inert gases.

3. An apparatus for removing substances from liquids in a column by flotation using bubbles by passing downwardly through the column a liquid containing the substances to be removed, while bubbling a gas through the column countercurrently to the descending liquid so as to bring the liquid into contact with the gas and thus absorb the substance on the ascending bubbles, which are then collected and separated from the liquid in the upper part of the column which comprises: (1) an outer vertical column of 5–30 cm in diameter and 0.8–5 m in length, provided in the upper part thereof with an opening for introducing a liquid containing a substance to be removed and in the bottom part thereof with a gas inlet, a gas-diffuser to create bubbles and an outlet for the liquid; and (2) an inner assembly placed inside said vertical column and extending from an intermediate portion of said column to the upper portion thereof; said assembly consisting of at least one conduit of diameter not greater than 4–5 cm and a length corresponding to about 8–25% of the total length of said outer column, an inverted funnel means at the lower end of said conduit for guiding said bubbles into said conduit, and a bubble collector and concentrator at the upper end of said conduit.

4. The apparatus according to claim 3, wherein said inner assembly consists of a plurality of conduits placed eccentrically inside said outer column.

* * * * *